US008491732B2

(12) United States Patent
Daitoh et al.

(10) Patent No.: US 8,491,732 B2
(45) Date of Patent: Jul. 23, 2013

(54) HOT-ROLLED STEEL BAR OR WIRE ROD

(75) Inventors: Yoshihiro Daitoh, Fukuoka (JP); Akira Kito, Fukuoka (JP); Takayuki Nakamura, Fukuoka (JP)

(73) Assignee: Nippon Steel & Sumitomo Metal Corporation, Tokyo (JP)

( * ) Notice: Subject to any disclaimer, the term of this patent is extended or adjusted under 35 U.S.C. 154(b) by 0 days.

(21) Appl. No.: 13/461,125

(22) Filed: May 1, 2012

(65) Prior Publication Data

US 2012/0263622 A1 Oct. 18, 2012

Related U.S. Application Data

(63) Continuation of application No. PCT/JP2010/068897, filed on Oct. 26, 2010.

(30) Foreign Application Priority Data

Nov. 5, 2009 (JP) ..... 2009-253742

(51) Int. Cl.
*C22C 38/18* (2006.01)
*C22C 38/22* (2006.01)
*C22C 38/44* (2006.01)

(52) U.S. Cl.
USPC ..... 148/320; 148/328; 148/333; 148/334; 148/335

(58) Field of Classification Search
USPC ..... 148/320, 328, 333–335, 595, 598, 148/599; 420/104–111, 128
See application file for complete search history.

(56) References Cited

U.S. PATENT DOCUMENTS 6,660,105 B1 12/2003 Ochi et al.

FOREIGN PATENT DOCUMENTS

| | | |
|---|---|---|
| JP | 56-075551 | 6/1981 |
| JP | 61-261427 | 11/1986 |
| JP | 11-106866 | 4/1999 |
| JP | 2004-204263 | 7/2004 |
| JP | 2008-127595 | 6/2008 |
| JP | 2008-189989 | 8/2008 |
| JP | 2009-052062 | 3/2009 |
| WO | 99/05333 | 2/1999 |

*Primary Examiner* — Deborah Yee
(74) *Attorney, Agent, or Firm* — Clark & Brody

(57) ABSTRACT

A hot-rolled steel bar or wire rod consisting of C: 0.1 to 0.3%, Si: 0.05 to 1.5%, Mn: 0.4 to 2.0%, S: 0.003 to 0.05%, Cr: 0.5 to 3.0%, Al: 0.02 to 0.05%, and N: 0.010 to 0.025%, the balance being Fe and impurities, and the impurities containing P: 0.025% or less, Ti: 0.003% or less, and O: 0.002% or less, wherein the structure thereof is composed of a ferrite-pearlite structure, ferrite-pearlite-bainite structure, or ferrite-bainite structure; the standard deviation of ferrite fractions at the time when randomly selected 15 viewing fields of a transverse cross section are observed and measured with the area per one viewing field being 62,500 $\mu m^2$ is 0.10 or less; and in a region from the surface to one-fifth of the radius and a region from the center to one-fifth of the radius in the transverse cross section, the amount of Al precipitating as AlN is 0.005% or less, and the density in terms of the number of AlN having a diameter of 100 nm or larger is $5/100$ $\mu m^2$ or less. In the hot-rolled steel bar or wire rod, even if hot forging is performed in various temperature ranges, austenite grains can be stably prevented from being coarsened at the time of heating for carburization.

4 Claims, No Drawings

HOT-ROLLED STEEL BAR OR WIRE ROD

The disclosure of International Application No. PCT/JP2010/068897 filed Jun. 9, 2010 including specification, drawings and claims is incorporated herein by reference in its entirety.

TECHNICAL FIELD

The present invention relates to a hot-rolled steel bar or wire rod. More particularly, it relates to a hot-rolled steel bar or wire rod that has an excellent property in preventing crystal grains from being coarsened at the time of carburizing or carbo-nitriding, and is suitable as a starting material for parts, such as gears, pulleys, and shafts, that are roughly formed by hot forging.

BACKGROUND ART

In many cases, parts such as gears, pulleys, and shafts for motor vehicles and industrial machinery are manufactured by roughly shaping them by hot forging or cold forging, by subjecting them to cutting work and thereafter to casehardening by carburizing quenching or carbo-nitriding quenching. Unfortunately, if pre-quenched austenite grains are coarsened by the heat from carburizing or carbo-nitriding, there easily arise problems that the fatigue strength as a part decreases and that the amount of deformation at the quenching time increases.

Generally, it has been thought that, as compared with cold-forged parts, in hot-forged parts, the austenite grains are less liable to be coarsened at the time of carburizing or carbo-nitriding. In recent years, however, with the progress of hot forging technique, hot forging has frequently been performed in various temperature ranges, and the number of hot-forged parts with the austenite grains coarsened at the time of carburizing or carbo-nitriding has increased. Therefore, there has been demanded a hot-rolled steel bar or wire rod in which austenite grains can be stably prevented from being coarsened at the heating time in the process of carburizing or carbo-nitriding even if hot forging is performed in various temperature ranges, and techniques concerning steels and/or producing methods therefor have been proposed in Patent Documents 1 to 3.

Specifically, Patent Document 1 discloses a "Grain stabilized carburizing steel" in which a steel with limited amounts of sol.Al and N and a limited ratio of "sol.Al/N" is heated to a temperature of 1200° C. or higher and thereafter is hot worked.

Patent Document 2 discloses a "Producing method of steel having superior cold workability and preventing coarsening of grain during carburization heating" in which the Al/N ratio and the "Al+2N" amount are limited, and further the amount of AlN precipitated in a rolled material and the ferrite grain size number are defined. As seen in the title of invention and the object of invention of Patent Document 2, the technique proposed in Patent Document 2 is premised on the fact that the steel is roughly formed as rolled by cold working, and subsequently is subjected to carburizing treatment.

Patent Document 3 discloses a "Case hardening steel excellent in preventability of coarse grain and its producing method" in which the amount of AlN precipitated, the bainite structure fraction, the ferrite band, and the like are defined. As described in the paragraph [0002] of Patent Document 3, the technique proposed in Patent Document 3 is also premised on the fact that the steel is roughly formed by cold forging, and subsequently is subjected to carburizing quenching

[Patent Document 1] JP56-75551A
[Patent Document 2] JP61-261427A
[Patent Document 3] JP11-106866A

DISCLOSURE OF THE INVENTION

Problems to be Solved by the Invention

In the techniques disclosed in Patent Documents 1 to 3, it could not necessarily be said that in the case where hot forging is performed in various temperature ranges, austenite grains can be stably prevented from being coarsened at the time of heating in the process of carburizing or carbo-nitriding.

That is, in the technique proposed in Patent Document 1, the steel is heated to a temperature of 1200° C. or higher, and thereafter is hot worked. However, in the hot forging in mass production, many parts are heated to a temperature lower than 1200° C. Therefore, Patent Document 1 does not propose a technique in which austenite grains can be stably prevented from being coarsened at the carburizing time even in the case where hot forging is performed in various temperature ranges.

In the technique proposed in Patent Document 2, the heating temperature in a center of a starting material is not considered. Further, although concerning the structure, the ferrite grain size number is defined, the distribution state of ferrite structure is not considered. Therefore, it cannot necessarily be said that in the case where hot forging is performed in various temperature ranges, austenite grains can be stably prevented from being coarsened at the time of heating for carburization.

The technique proposed in Patent Document 3 does not also consider the heating temperature in a center of a starting material. Further, although concerning the structure, the bainite structure fraction and the ferrite band are defined, the distribution state of ferrite is not considered. Therefore, it cannot necessarily be said that in the case where hot forging is performed in various temperature ranges, austenite grains can be stably prevented from being coarsened at the time of heating for carburization.

The present invention has been made in view of the aforementioned present situation, and accordingly an objective thereof is to provide a hot-rolled steel bar or wire rod in which austenite grains can be stably prevented from being coarsened when the steel is heated in the process of carburizing or carbo-nitriding, especially when the steel is heated at a temperature of 980° C. or lower for three hours or shorter even if being hot forged in various temperature ranges, especially being hot forged after being heated to 900 to 1200° C., and which is suitable as a starting material for parts that are roughly formed by hot forging.

In the present invention, the case where two or more austenite grains having a grain size number of 5 or less exist when randomly selected ten viewing fields are observed with the size of each viewing field being 1.0 mm×1.0 mm is defined as the coarsening of austenite grains.

Means for Solving the Problems

So far, it has been known that as disclosed in Patent Document 2 and Patent Document 3, by reducing the amount of AlN precipitated at the stage of hot-rolled material, austenite grains can be prevented from being coarsened at the time of heating for carburization in the case where the steel is roughly formed by cold working (cold forging). However, it cannot necessarily be said that in the case where hot forging is performed in various temperature ranges, even if the amount of AlN precipitated is reduced at the stage of hot-rolled material, austenite grains can be stably prevented from being coarsened when the steel is heated for carburization at a temperature of 980° C. or lower.

Accordingly, the present inventors carried out investigations and studies repeatedly on the influences of the precipitated amount and dispersed state of AlN, and micro-structure exerted on a hot-rolled steel bar or wire rod in which austenite grains can be stably prevented from being coarsened even if the steel is heated at a temperature of 980° C. or lower in the process of carburizing or carbo-nitriding in the case where hot forging is performed in various temperature ranges. As the result, the present inventors obtained the findings of items (a) to (e). In the description below, "carburizing or carbo-nitriding" is sometimes referred simply to as "carburizing". Unless otherwise noted, "heating for carburization" means "heating at a temperature of 980° C. or lower for carburization."

(a) Even in the case where the steel is roughly formed by hot forging, as the amount of AlN precipitated decreases at the stage of hot-rolled material, austenite grains are less liable to be coarsened at the time of heating for carburization.

(b) In a cast piece after being subjected to continuous casting in a large cross-section, which is general in a mass production process, coarse AlN is produced. If the coarse AlN remains, even if the amount of AlN precipitated is small, austenite grains are liable to be coarsened at the time of heating for carburization.

(c) In the heating of a cast piece and a slab obtained by the blooming of the cast piece, it takes much time for the temperature of the center to become equivalent to the temperature of the surface because the temperature rises from the surface side. Therefore, in the case of general heating, in the center of the hot-rolled material, the amount of AlN precipitated and the amount of coarse AlN grains increase as compared with the outer layer portion, so that austenite grains cannot necessarily be prevented stably from being coarsened at the time of heating for carburization.

(d) The amount of AlN precipitated is generally determined by analyzing the residues electrolytically extracted from the outer layer portion. Therefore, the amount of AlN precipitated determined by the general extracted residue analysis does not serve as an index of preventing austenite grains from being coarsened at the time of heating for carburization in the vicinity of the center. In order to attain prevention of austenite grains from being coarsened at the time of heating for carburization in the vicinity of the center, the amount of AlN precipitated in the vicinity of the center must also be decreased to a predetermined amount or smaller.

(e) Even after hot forging has been performed, the nonuniformity of micro-structure in the steel material cross section at the stage of hot-rolled material is related to the coarsened state of austenite grains at the time of heating for carburization. If the variations in ferrite fraction of the hot-rolled material are decreased, austenite grains become less liable to be coarsened at the time of heating for carburization.

The present invention was completed based on the above findings, and the gists thereof are hot-rolled steel bars or wire rods described in the following items (1) to (3).

(1) A hot-rolled steel bar or wire rod having a chemical composition consisting of, by mass percent, C: 0.1 to 0.3%, Si: 0.05 to 1.5%, Mn: 0.4 to 2.0%, S: 0.003 to 0.05%, Cr: 0.5 to 3.0%, Al: 0.02 to 0.05%, and N: 0.010 to 0.025%, the balance being Fe and impurities, and the contents of P, Ti and O (oxygen) in the impurities being P: 0.025% or less, Ti: 0.003% or less, and O: 0.002% or less, wherein the structure of the hot-rolled steel bar or wire rod is composed of a ferrite-pearlite structure, ferrite-pearlite-bainite structure, or ferrite-bainite structure;

the standard deviation of ferrite fractions at the time when randomly selected 15 viewing fields of a transverse cross section are observed and measured with the area per one viewing field being 62,500 $\mu m^2$ is 0.10 or less; and when a region from the surface to one-fifth of the radius and a region from the center to one-fifth of the radius in the transverse cross section are observed, in each of the regions, the amount of Al precipitating as AlN is 0.005% or less, and the density in terms of the number of AlN having a diameter of 100 nm or larger is $5/100$ $\mu m^2$ or less.

(2) The hot-rolled steel bar or wire rod described in item (1), wherein the chemical composition further contains, by mass percent, at least one element selected from Ni: 1.5% or less and Mo: 0.8% or less in place of some of Fe.

(3) The hot-rolled steel bar or wire rod described in item (1) or (2), wherein the hot-rolled steel bar or wire rod contains, by mass percent, at least one element selected from Nb: 0.08% or less and V: 0.2% or less in lieu of part of Fe.

The "impurities" in "Fe and impurities" of the balance are elements that mixedly enter from the ore and scrap used as raw materials, the environment, or the like when a steel material is produced on an industrial scale.

The "diameter" of AlN is the arithmetic mean of the major axis and the minor axis of AlN of the extraction replica specimen prepared by the general method, which are observed and measured by using a transmission electron microscope.

The "ferrite-pearlite structure" is a mixed structure of ferrite and pearlite, the "ferrite-pearlite-bainite structure" is the mixed structure of ferrite, pearlite, and bainite, and the "ferrite-bainite structure" is the mixed structure of ferrite and bainite.

The "ferrite" that forms each of the mixed structure does not include ferrite in pearlite.

Advantage of the Invention

The hot-rolled steel bar or wire rod in accordance with the present invention can be suitably used as a starting material for parts, such as gears, pulleys, and shafts, that are roughly formed by hot forging because austenite grains can be stably prevented from being coarsened when the steel is heated in the process of carburizing or carbo-nitriding, especially when the steel is heated at a temperature of 980° C. or lower for three hours or shorter even if being hot forged in various temperature ranges, especially being hot forged after being heated to 900 to 1200° C.

BEST MODE FOR CARRYING OUT THE INVENTION

Hereunder, the requirements of the present invention are explained in detail. An ideogram of "%" relating to the content of each element means "mass percent".

(A) Chemical Composition

C: 0.1 to 0.3%

Carbon (C) is an essential element for securing the core strength of a part subjected to carburizing quenching or carbo-nitriding quenching. The C content lower than 0.1% is insufficient to achieve the effect. On the other hand, if the C content exceeds 0.3%, the machinability after hot forging decreases remarkably. Therefore, the C content is 0.1 to 0.3%. The C content is preferably 0.18% or more, and preferably 0.25% or less.

Si: 0.05 to 1.5%

Silicon (Si) is an element having an effect of improving the fatigue strength because of having an effect of enhancing the hardenability and the temper softening resistance. However, if the Si content is less than 0.05%, the effect is insufficient. On the other hand, if the Si content exceeds 1.5%, not only the effect of enhancing the fatigue strength saturates but also the machinability after hot forging decreases remarkably. Therefore, the Si content is 0.05 to 1.5%. When the Si content is 0.4% or more, the effect of improving the fatigue strength is remarkable, so that the Si content is preferably 0.4% or more. The Si content is preferably 0.8% or less.

Mn: 0.4 to 2.0%

Manganese (Mn) is an element having an effect of improving the fatigue strength because of having an effect of enhancing the hardenability and the temper softening resistance. However, if the Mn content is less than 0.4%, the effect is insufficient. On the other hand, if the Mn content exceeds 2.0%, not only the effect of enhancing the fatigue strength saturates but also the machinability after hot forging decreases remarkably. Therefore, the Mn content is 0.4 to 2.0%. The Mn content is preferably 0.8% or more and 1.2% or less.

S: 0.003 to 0.05%

Sulfur (S) combines with Mn to form MnS, and improves the machinability. However, if the S content is less than 0.003%, the effect cannot be achieved. On the other hand, if the S content increases, coarse MnS is liable to be produced, which tends to degrade the fatigue strength. In particular, if the S content exceeds 0.05%, the fatigue strength degrades remarkably. Therefore, the S content is 0.003 to 0.05%. The S content is preferably 0.01% or more and 0.03% or less.

Cr: 0.5 to 3.0%

Chromium (Cr) is an element having an effect of improving the fatigue strength because of having an effect of enhancing the hardenability and the temper softening resistance. However, if the Cr content is less than 0.5%, the effect is insufficient. On the other hand, if the Cr content exceeds 3.0%, not only the effect of enhancing the fatigue strength saturates but also the machinability after hot forging decreases remarkably. Therefore, the Cr content is 0.5 to 3.0%. When the Cr content is 1.3% or more, the effect of improving the fatigue strength is remarkable, so that the Cr content is preferably 1.3% or more. The Cr content is preferably 2.0% or less.

Al: 0.02 to 0.05%

Aluminum (A) is an element effective in preventing austenite grains from being coarsened at the time of heating for carburization because of having an action for deoxidation and simultaneously being liable to form AlN by combining with N. However, if the Al content is less than 0.02%, even if other requirements are met, an effect of preventing austenite grains from being coarsened, which is the target of the present invention, of the later-described requirement of "coarse grains are not formed when the steel is heated at a temperature of 980° C. or lower for three hours" cannot be achieved. If the Al content exceeds 0.05%, likewise, even if other requirements are met, the effect of preventing austenite grains from being coarsened, which is the target of the present invention, cannot be achieved. Therefore, the Al content is 0.02 to 0.05%. The Al content is preferably 0.03% or more and 0.04% or less.

N: 0.010 to 0.025%

Nitrogen (N) is an element that is liable to form AlN, NbN, VN, and TiN by combining with Al, Nb, V, and Ti. In the present invention, among the nitrides, AlN, NbN, and VN have an effect of preventing austenite grains from being coarsened at the time of heating for carburization. However, if the N content is less than 0.010%, even if other requirements are met, the effect of preventing austenite grains from being coarsened, which is the target of the present invention, cannot be achieved. On the other hand, if the N content exceeds 0.025%, especially in the steel making process, stable mass production becomes difficult to achieve. Therefore, the N content is 0.010 to 0.025%. The N content is preferably 0.013% or more and 0.020% or less.

One of the chemical compositions of the hot-rolled steel bar or wire rod in accordance with the present invention is a chemical composition in which besides the elements, the balance consists of Fe and impurities, and the contents of P, Ti and O (oxygen) in the impurities are P: 0.025% or less, Ti: 0.003% or less, and O: 0.002% or less.

Hereunder, P, Ti and O in the impurities are explained.

P: 0.025% or Less

Phosphorus (P) is an element that segregates at grain boundaries and is liable to embrittle the grain boundaries. If the P content exceeds 0.025%, the fatigue strength is decreased. Therefore, the content of P in the impurities is 0.025% or less. The content of P in the impurities is preferably 0.015% or less.

Ti: 0.003% or Less

Titanium (Ti) is liable to form hard and coarse TiN by combining with N, and decreases the fatigue strength. Especially, if the Ti content exceeds 0.003%, the fatigue strength decreases remarkably. Therefore, the content of Ti in the impurities is 0.003% or less. The content of Ti as an impurity element is preferably 0.002% or less.

O: 0.002% or Less

Oxygen (O) is liable to form hard oxide-base inclusions by combining with Al, and decreases the fatigue strength. Especially, if the O content exceeds 0.002%, the fatigue strength decreases remarkably. Therefore, the content of O in the impurities is 0.002% or less. The content of O as an impurity element is preferably 0.001% or less.

Another of the chemical compositions of the hot-rolled steel bar or wire rod in accordance with the present invention is a chemical composition that contains at least one element of elements selected from Ni, Mo, Nb, and V in lieu of part of Fe.

Hereunder, the operational advantages of Ni, Mo, Nb, and V, which are optional elements, and the reason for restricting the content of each of these elements are explained.

Both of Ni and Mo have an action for enhancing the hardenability. Therefore, in the case where it is desired to obtain higher hardenability, these elements may be contained. Hereunder, Ni and Mo are explained.

Ni: 1.5% or Less

Nickel (Ni) is an element that has an effect of enhancing the hardenability and is effective in further increasing the fatigue strength, and therefore may be contained as necessary. However, if the Ni content exceeds 1.5%, not only the effect of enhancing the fatigue strength due to the improvement in hardenability saturates but also the machinability after hot forging decreases remarkably. Therefore, the amount of Ni, if contained, is 1.5% or less. The amount of Ni, if contained, is preferably 0.8% or less.

On the other hand, in order to reliably achieve the effect of enhancing the fatigue strength due to the improvement in hardenability of Ni, the amount of Ni, if contained, is preferably 0.1% or more.

Mo: 0.8% or Less

Molybdenum (Mo) is an element effective in further increasing the fatigue strength because of having an effect of enhancing the hardenability and further enhancing the temper softening resistance, and therefore may be contained as necessary. However, if the Mo content exceeds 0.8%, not only the effect of increasing the fatigue strength saturates but also the machinability after hot forging decreases remarkably. Therefore, the amount of Mo, if contained, is 0.8% or less. The amount of Mo, if contained, is preferably 0.4% or less.

On the other hand, in order to reliably achieve the effect of increasing the fatigue strength due to the improvement in hardenability and temper softening resistance of Mo, the amount of Mo, if contained, is preferably 0.05% or more.

The Ni and Mo can be contained in either one kind or compositely in two kinds. The total content of these elements may be 2.3% or less, but is preferably 1.2% or less.

Both of Nb and V have an action for complementing the prevention of austenite grains from being coarsened at the time of heating for carburization due to AlN, so that these elements may be contained. Hereunder, the Nb and V are explained.

Nb: 0.08% or Less

Niobium (Nb) is an element effective in complementing the prevention of austenite grains from being coarsened at the time of heating for carburization due to AlN because Nb is liable to form NbC, NbN, Nb(C,N) by combining with C and N. However, if the Nb content exceeds 0.08%, the effect of preventing austenite grains from being coarsened is rather deteriorated. For this reason, the alloy cost goes up, and the economical efficiency is impaired. Therefore, the amount of Nb, if contained, is 0.08% or less. The amount of Nb, if contained, is preferably 0.04% or less.

On the other hand, in order to reliably achieve the effect of preventing austenite grains from being coarsened of Nb, the amount of Nb, if contained, is preferably 0.01% or more.

V: 0.2% or Less

Vanadium (V) is likely to form VN and VC by combining with C and N, and, of these two, VN is effective in complementing the prevention of austenite grains from being coarsened at the time of heating for carburization due to AlN. However, if the V content exceeds 0.2%, the effect of preventing austenite grains from being coarsened is rather deteriorated. For this reason, the alloy cost goes up, and the economical efficiency is impaired. Therefore, the amount of V, if contained, is 0.2% or less. The amount of V, if contained, is preferably 0.1% or less.

On the other hand, in order to reliably achieve the effect of preventing austenite grains from being coarsened of V, the amount of V, if contained, is preferably 0.02% or more.

The Nb and V can be contained in either one kind or compositely in two kinds. The total content of these elements may be 0.28% or less, but is preferably 0.14% or less.

(B) Amount of Al Precipitating as AlN and Density in Terms of the Number of AlN Having a Diameter of 100 Nm or Larger in Each of Regions at the Time when a Region from the Surface to One-Fifth of the Radius and a Region from the Center to One-Fifth of the Radius in the Transverse Cross Section are Observed Since the cast piece and slab each have a large cross section, it takes much time for the center to reach a predetermined temperature. Therefore, when the cast piece and slab are heated, generally, the center has a low temperature as compared with the outer layer portion, or the time period during which the cast piece and slab are held at a predetermined temperature is short. For this reason, at the stage of hot-rolled steel bar or wire rod, at which a hot-worked state is established, the amount of AlN precipitated and the dispersed state are different between the outer layer portion and the center, so that a difference also occurs in the coarsening of austenite grains.

However, when the region from the surface to one-fifth of the radius and the region from the center to one-fifth of the radius in the transverse cross section are observed, if, in each of the regions, the amount of Al precipitating as AlN is 0.005% or less and the density in terms of the number of AlN having a diameter of 100 nm or larger is $5/100$ $\mu m^2$ or less, austenite grains can be restrained from being coarsened at the time of heating for carbonization in the whole region from the outer layer to the center even if the steel is hot forged after being heated to various temperatures between 900° C. and 1200° C.

Therefore, in the present invention, it was defined that when the region from the surface to one-fifth of the radius and the region from the center to one-fifth of the radius in the transverse cross section are observed, if, in each of the regions, the amount of Al precipitating as AlN is 0.005% or less and the density in terms of the number of AlN having a diameter of 100 nm or larger is $5/100$ $\mu m^2$ or less.

The amount of Al precipitating as AlN can be determined as described below. For example, an appropriate test specimen is sampled. After the transverse cross section of this test specimen has been masked with a resin so as not to be electrolytically polished, extraction (electrolysis) is carried out at a current density of 250 to 350 $\mu m^2$ by using a 10% AA-based electrolyte, which is the general condition, and the extracted solution is filtrated with a filter having a mesh size of 0.2 μm. Thereafter, the filtrated substance is chemically analyzed by the general method to determine the Al amount. At the time of filtration, by using the 0.2-μm filter, most of precipitates of nm size can be taken. The aforementioned 10% AA-based electrolyte is a 10-vol % acetylacetone-1 mass % tetramethylammonium chloride-methanol solution.

The density in terms of the number of AlN having a diameter of 100 nm or larger in the two regions can be determined as a density per 100 $\mu m^2$ of area by the method described below. For example, an extraction replica specimen is prepared from each of the regions by the general method, and ten viewing fields are observed by using a transmission electron microscope with the magnification being ×20,000 and the area per one viewing field being 10 $\mu m^2$.

In each of the two regions, the amount of Al precipitating as AlN is preferably 0.003% or less, and the density in terms of the number of AlN having a diameter of 100 nm or larger is preferably $3/100$ $\mu m^2$ or less.

(C) Micro-Structure

It is thought that the tendency of the nonuniformity of micro-structure at the stage of hot-rolled steel bar or wire rod in a hot-worked state is carried on even after the material has been hot forged to roughly form required parts such as gears, and the nonuniformity of micro-structure exerts an influence on the property of preventing austenite grains from being coarsened at the time of heating for carburization.

Therefore, a proper micro-structure is needed. In the case where the structure is composed of a ferrite-pearlite structure, ferrite-pearlite-bainite structure, or ferrite-bainite structure, and the standard deviation of ferrite fractions at the time when randomly selected 15 viewing fields of a transverse cross section are observed and measured with the area per one viewing field being 62,500 $\mu m^2$ is 0.10 or less, austenite grains can be prevented from being coarsened at the time of heating for carburization.

In the case where martensite is contained in the structure, because martensite is hard and low in ductility, a crack is liable to be produced on the hot-rolled steel bar or wire rod at the time of straightening and transportation.

Since the ferrite structure does not contain cementite, the distribution state thereof is liable to be affected even after hot forging as compared with the pearlite structure and bainite structure containing cementite. Therefore, if the structure is various mixed structures containing the ferrite structure, and the standard deviation of the ferrite fractions is 0.10 or less, the variations in micro-structure in the cross section at the stage of hot-rolled steel bar or wire rod are small, and austenite grains can be prevented from being coarsened at the time of heating for carburization.

The "phase" in the structure can be identified by the method described below. For example, a test specimen is cut out of a cross section that is perpendicular to the longitudinal direction of hot-rolled steel bar or wire rod and includes the center, and is mirror polished and corroded with nital, and randomly selected 15 viewing fields of the test specimen are observed with the magnification being ×400 and the size of viewing field being 250 μm×250 μm to identify the phase. Further, from the ferrite fraction (area fraction) determined by image analysis of the viewing fields using the ordinary method, the standard deviation of ferrite fractions can be calculated.

The standard deviation of ferrite fractions is preferably 0.07 or smaller.

The amount of Al precipitating as AlN, the density in terms of the number of AlN (dispersed state), and the micro-structure are affected by the chemical composition of steel, the production conditions of cast piece and slab, the segregation of component elements in the cast piece and slab, the hot-working conditions of the hot-rolled steel bar or wire rod, and the cooling rate after hot working.

Accordingly, as one example of a method for obtaining the amount of Al precipitating as AlN, the AlN dispersed state, and the micro-structure, there is shown a case where a steel containing 0.20 to 0.25% of C, 0.4 to 0.8% of Si, 0.5 to 0.8% of Mn, and 1.0 to 1.5% of Cr is used. Needless to say, the producing method for the hot-rolled steel bar or wire rod of the present invention is not limited to this.

To apply rolling reduction to the cast piece during solidification

To heat the cast piece at a heating temperature of 1250 to 1300° C. for a heating time of five hours or longer and thereafter to bloom the cast piece To allow the slab having been bloomed to cool To hot work the slab with the heating temperature being 1230 to 1280° C. and the heating time being one and a half hours or longer To finish work the slab at the hot work finishing temperature of 950 to 1050° C., and thereafter to cool the slab to a temperature of 600° C. or lower at a cooling rate of allowing cooling in the atmosphere (hereinafter, referred simply to as "allowing cooling")

To make the forging ratio from slab to steel bar or wire rod (the cross-sectional area of slab/the cross-sectional area of steel bar or wire rod) eight or more After finish working in hot working, the slab need not be cooled to room temperature at a cooling rate of allowing cooling or lower. When a temperature of 600° C. or lower is reached, the slab may be cooled by an appropriate means such as air cooling, mist cooling, or water cooling.

The heating temperature in this description means the average value of in-furnace temperatures in a heating furnace, and the heating time means time period during which the slab is heated in the furnace. The finishing temperature of hot working is the surface temperature of steel bar or wire rod, and further the cooling rate after finish working is the surface cooling rate of steel bar or wire rod.

Hereunder, the present invention is explained in more detail based on examples.

EMBODIMENT

Example 1

Steel α and steel β each having a chemical composition given in Table 1 were put into a 70-ton converter to regulate the components. Thereafter, the steels were subjected to continuous casting to form a cast piece (bloom) of 400 mm×300 mm square, and were cooled to 600° C. At a stage during solidification in continuous casting, rolling reduction was applied. Both of steel α and steel β are steels whose chemical compositions are within the range defined in the present invention.

The cast piece thus produced was heated to a temperature of 600 to 1280° C., thereafter being bloomed to form a slab of 180 mm×180 mm square, and was cooled to room temperature. Further, the 180 mm×180 mm square slab was heated, and thereafter was hot rolled to form a steel bar having a diameter of 40 mm.

Table 2 gives, as production conditions (1) to (9), the details of the heating condition of cast piece, the cooling condition after blooming, the heating condition of slab, the rolling finishing temperature of steel bar rolling, and the cooling condition after rolling at the time when the cast piece of 400 mm×300 mm is finished to the 40 mm-diameter steel bar.

TABLE 1

| | Chemical composition (mass %) Balance: Fe and impurities | | | | | | | | | | |
|---|---|---|---|---|---|---|---|---|---|---|---|
| Steel | C | Si | Mn | P | S | Cr | Mo | Al | Ti | N | O |
| α | 0.21 | 0.23 | 0.85 | 0.012 | 0.019 | 1.12 | — | 0.034 | 0.001 | 0.0163 | 0.0010 |
| β | 0.20 | 0.08 | 0.86 | 0.015 | 0.021 | 1.08 | 0.12 | 0.029 | 0.001 | 0.0157 | 0.0008 |

TABLE 2

| | Cast piece | | | Slab | | Steel bar rolling | |
|---|---|---|---|---|---|---|---|
| Production condition sign | Heating temperature (° C.) | Heating time ( min) | Cooling condition after blooming | Heating temperature (° C.) | Heating time (min) | Rolling finishing temperature (° C.) | Cooling condition |
| <1> | 1280 | 60 | Allowing to cool | 1250 | 90 | 1000 | Allowing to cool |
| <2> | 1280 | 360 | Allowing to cool | 1250 | 90 | 1000 | Allowing to cool |
| <3> | 1280 | 360 | Slow cooling for 20 hours | 1250 | 90 | 1000 | Allowing to cool |
| <4> | 1280 | 360 | Allowing to cool | 1150 | 120 | 980 | Allowing to cool |
| <5> | 1280 | 360 | Allowing to cool | 1250 | 40 | 980 | Allowing to cool |

TABLE 2-continued

| | Cast piece | | | Slab | | Steel bar rolling | |
|---|---|---|---|---|---|---|---|
| Production condition sign | Heating temperature (° C.) | Heating time (min) | Cooling condition after blooming | Heating temperature (° C.) | Heating time (min) | Rolling finishing temperature (° C.) | Cooling condition |
| <6> | 1280 | 360 | Allowing to cool | 1250 | 90 | 900 | Slow cooling to 600° C. |
| <7> | 1280 | 360 | Allowing to cool | 1250 | 90 | 1080 | Allowing to cool |
| <8> | 1280 | 60 | Allowing to cool | 1150 | 120 | 980 | Allowing to cool |
| <9> | 1280 | 360 | Allowing to cool | 1250 | 90 | 950 | Allowing to cool |

"Allowing to cool" in "Cooling condition after blooming" column and "Steel bar rolling" column means allowing to cool in the atmosphere.
"Slow cooling for 20 hours" in "Cooling condition after blooming" column of Production condition (3) indicates that cooling was performed to room temperature for 20 hours.
Cooling after "Slow cooling to 600° C." in "Steel bar rolling" column of Production condition (6) was allowing to cool in the atmosphere.

For each of the 40 mm-diameter steel bars obtained as described above, the region from the surface to one-fifth of the radius and the region from the center to one-fifth of the radius in the transverse cross section were observed, and the amount of Al precipitating as AlN and the density in terms of the number of AlN having a diameter of 100 nm or larger were examined, and also the structure and the standard deviation of ferrite fractions at the time when randomly selected 15 viewing fields of a transverse cross section were observed and measured with the area per one viewing field being 62,500 $\mu m^2$ were examined. Further, a test simulating the heating in hot forging and carburizing was conducted to examine the presence of occurrence of coarse grains. Hereunder, the specific examination methods are explained.

First, since scale is present on the surface of the 40 mm-diameter steel bar, the extracted residue analysis cannot be performed as it is. Therefore, by turning, a test specimen having a diameter of 39 mm and a length of 10 mm and a test specimen having a diameter of 8 mm and a length of 20 mm were sampled from the concentric positions. After the transverse cross section of each of the test specimens had been masked with a resin so as not to be electrolytically polished, extraction (electrolysis) was carried out at a current density of 250 to 350 $A/m^2$ by using a 10% AA-based electrolyte, which is the general condition, and the extracted solution was filtrated with a filter having a mesh size of 0.2 μm. Thereafter, the filtrated substance was chemically analyzed by the general method to determine the amount of Al precipitating as AlN.

In the transverse section of the steel bar having a diameter of 40 mm, from each of the region from the surface to one-fifth of the radius and the region from the center to one-fifth of the radius, an extraction replica specimen was prepared by the general method, and ten viewing fields were observed by using a transmission electron microscope with the magnification being ×20,000 and the area per one viewing field being 10 $\mu m^2$, whereby the density in terms of the number of AlN having a diameter of 100 nm or larger per 100 $\mu m^2$ of area was determined.

A test specimen was cut out of a cross section that was perpendicular to the longitudinal direction of 40 mm-diameter steel bar and included the center, and was mirror polished and corroded with nital, and randomly selected 15 viewing fields of the test specimen were observed with the magnification being ×400 and the size of viewing field being 250 μm×250 μm to examine the structure. Further, the ferrite fractions (area fractions) were determined by image analysis of the viewing fields by using the ordinary method, and from the analysis results, the standard deviation of ferrite fractions was calculated.

A test specimen having a length of 60 mm was cut out of the 40 mm-diameter steel bar, and was heated at temperatures of 1200° C., 1100° C., 1000° C., and 900° C. for 30 minutes to simulate hot forging. Thereafter, after 10 seconds from when the test specimen was taken out of the furnace, the test specimen was compressed by 60% in the height direction of the columnar shape, and subsequently was allowed to cool to room temperature. The test specimen thus obtained was further heated at 930° C. for one hour, and then was allowed to cool to room temperature.

Next, the test specimen obtained as described above was cut into four equal pieces in the longitudinal cross section direction, being held at temperatures of 950° C., 980° C., 1010° C., and 1040° C. for three hours to simulate heating for carburization, and thereafter was cooled to room temperature by water cooling. The cut surface of the test specimen thus obtained was removed by a thickness of 1 mm, and the cut surface was mirror polished and was corroded with a picric acid saturated aqueous solution to which a surface active agent was added. Then, randomly selected ten viewing fields were observed by using an optical microscope at a magnification of ×100 to examine the state in which the coarsening phenomenon of austenite grains occurred. The size of each viewing field in this examination was 1.0 mm×1.0 mm, and in the case where it was found by this examination that two or more austenite grains having a grain number of 5 or less were present, it was judged that austenite grains were coarsened. The target of the effect of preventing austenite grains from being coarsened was made that austenite grains are not coarsened when the steel is heated at a temperature of 980° C. or lower for three hours.

Tables 3 and 4 summarize the results of the aforementioned examinations together with the production conditions of steel bar and the temperature at which the steel bar was heated to simulate hot forging. The production condition signs in Tables 3 and 4 correspond to the condition signs described in Table 2.

TABLE 3

| Steel | Production condition sign | Region from surface to 1/5 of radius in transverse cross section: Al as AlN(%) | Region from surface to 1/5 of radius in transverse cross section: AlN having a diameter of 100 nm or larger (number/100 μm²) | Region from center to 1/5 of radius in transverse cross section: Al as AlN(%) | Region from center to 1/5 of radius in transverse cross section: AlN having a diameter of 100 nm or larger (number/100 μm²) | Standard deviation of ferrite fractions | Structure | Heating temperature in forging (° C.) | Formation temperature of coarsened austenite grains (° C.) | Classification |
|---|---|---|---|---|---|---|---|---|---|---|
| α | <1> | 0.002 | 1 | 0.005 | *8 | 0.05 | F + P + B | 1200 | 1040 | Comparative |
| | | | | | | | | 1100 | #950 | |
| | | | | | | | | 1000 | #980 | |
| | | | | | | | | 900 | 1010 | |
| | <2> | 0.002 | 0 | 0.002 | 1 | 0.04 | F + P + B | 1200 | >1040 | Invention |
| | | | | | | | | 1100 | 1010 | |
| | | | | | | | | 1000 | 1040 | |
| | | | | | | | | 900 | >1040 | |
| | <3> | 0.003 | *9 | 0.004 | *10 | 0.04 | F + P + B | 1200 | 1040 | Comparative |
| | | | | | | | | 1100 | #950 | |
| | | | | | | | | 1000 | #950 | |
| | | | | | | | | 900 | #980 | |
| | <4> | *0.011 | 5 | *0.012 | 3 | 0.03 | F + P | 1200 | >1040 | Comparative |
| | | | | | | | | 1100 | #950 | |
| | | | | | | | | 1000 | #980 | |
| | | | | | | | | 900 | 1010 | |
| | <5> | 0.003 | 1 | *0.007 | *7 | 0.05 | F + P + B | 1200 | 1040 | Comparative |
| | | | | | | | | 1100 | #950 | |
| | | | | | | | | 1000 | #980 | |
| | | | | | | | | 900 | 1010 | |
| | <6> | *0.008 | 0 | *0.009 | 1 | 0.02 | F + P | 1200 | >1040 | Comparative |
| | | | | | | | | 1100 | #950 | |
| | | | | | | | | 1000 | #980 | |
| | | | | | | | | 900 | 1010 | |
| | <7> | 0.002 | 0 | 0.003 | 1 | *0.11 | F + P + B | 1200 | >1040 | Comparative |
| | | | | | | | | 1100 | #980 | |
| | | | | | | | | 1000 | #980 | |
| | | | | | | | | 900 | #950 | |
| | <8> | *0.014 | *15 | *0.017 | *24 | 0.04 | F + P | 1200 | 1010 | Comparative |
| | | | | | | | | 1100 | #950 | |
| | | | | | | | | 1000 | #950 | |
| | | | | | | | | 900 | #950 | |
| | <9> | 0.003 | 0 | 0.004 | 1 | 0.03 | F + P | 1200 | >1040 | Invention |
| | | | | | | | | 1100 | 1010 | |
| | | | | | | | | 1000 | 1040 | |
| | | | | | | | | 900 | 1040 | |

"Invention" in classification column indicates example embodiment of the present invention, and "Comparative" indicates comparative example.
Production condition signs correspond to condition signs described in Table 2.
"Al as AlN" means the amount of Al precipitating as AlN.
"F" in Structure column indicates ferrite, "P" indicates pearlite, and "B" indicates bainite.
*mark indicates that the value deviates from the condition defined in the present invention.
#mark indicates that the target is not reached.

TABLE 4

| Steel | Production condition sign | Region from surface to 1/5 of radius in transverse cross section: Al as AlN(%) | Region from surface to 1/5 of radius in transverse cross section: AlN having a diameter of 100 nm or larger (number/100 μm²) | Region from center to 1/5 of radius in transverse cross section: Al as AlN(%) | Region from center to 1/5 of radius in transverse cross section: AlN having a diameter of 100 nm or larger (number/100 μm²) | Standard deviation of ferrite fractions | Structure | Heating temperature in forging (° C.) | Formation temperature of coarsened austenite grains (° C.) | Classification |
|---|---|---|---|---|---|---|---|---|---|---|
| β | <1> | 0.002 | 1 | 0.004 | *6 | 0.06 | F + P + B | 1200 | 1040 | Comparative |
| | | | | | | | | 1100 | #950 | |
| | | | | | | | | 1000 | #980 | |
| | | | | | | | | 900 | 1010 | |
| | <2> | 0.002 | 0 | 0.002 | 0 | 0.08 | F + P + B | 1200 | >1040 | Invention |
| | | | | | | | | 1100 | 1010 | |
| | | | | | | | | 1000 | 1040 | |
| | | | | | | | | 900 | >1040 | |
| | <3> | 0.003 | *7 | 0.004 | *8 | 0.06 | F + P + B | 1200 | 1040 | Comparative |
| | | | | | | | | 1100 | #950 | |
| | | | | | | | | 1000 | #950 | |
| | | | | | | | | 900 | #980 | |
| | <4> | *0.0091 | 4 | *0.011 | 3 | 0.03 | F + P + B | 1200 | >1040 | Comparative |
| | | | | | | | | 1100 | #950 | |

TABLE 4-continued

| Steel | Production condition sign | Region from surface to 1/5 of radius in transverse cross section: Al as AlN(%) | Region from surface to 1/5 of radius in transverse cross section: AlN having a diameter of 100 nm or larger (number/100 μm²) | Region from center to 1/5 of radius in transverse cross section: Al as AlN(%) | Region from center to 1/5 of radius in transverse cross section: AlN having a diameter of 100 nm or larger (number/100 μm²) | Standard deviation of ferrite fractions | Structure | Heating temperature in forging (° C.) | Formation temperature of coarsened austenite grains (° C.) | Classification |
|---|---|---|---|---|---|---|---|---|---|---|
| | | | | | | | | 1000 | #980 | |
| | | | | | | | | 900 | 1010 | |
| | <5> | 0.003 | 1 | *0.006 | *6 | 0.05 | F + P + B | 1200 | 1040 | Comparative |
| | | | | | | | | 1100 | #950 | |
| | | | | | | | | 1000 | #980 | |
| | | | | | | | | 900 | 1010 | |
| | <6> | *0.008 | 0 | *0.009 | 1 | 0.03 | F + P | 1200 | >1040 | Comparative |
| | | | | | | | | 1100 | #950 | |
| | | | | | | | | 1000 | #980 | |
| | | | | | | | | 900 | 1010 | |
| | <7> | 0.002 | 0 | 0.002 | 1 | *0.12 | F + B | 1200 | >1040 | Comparative |
| | | | | | | | | 1100 | #980 | |
| | | | | | | | | 1000 | #980 | |
| | | | | | | | | 900 | #950 | |
| | <8> | *0.013 | *13 | *0.015 | *21 | 0.04 | F + P | 1200 | 1010 | Comparative |
| | | | | | | | | 1100 | #950 | |
| | | | | | | | | 1000 | #950 | |
| | | | | | | | | 900 | #950 | |
| | <9> | 0.003 | 0 | 0.003 | 0 | 0.04 | F + P | 1200 | >1040 | Invention |
| | | | | | | | | 1100 | 1010 | |
| | | | | | | | | 1000 | 1040 | |
| | | | | | | | | 900 | 1040 | |

"Invention" in classification column indicates example embodiment of the present invention, and "Comparative" indicates comparative example.
Production condition signs correspond to condition signs described in Table 2.
"Al as AlN" means the amount of Al precipitating as AlN.
"F" in Structure column indicates ferrite, "P" indicates pearlite, and "B" indicates bainite.
*mark indicates that the value deviates from the condition defined in the present invention.
#mark indicates that the target is not reached.

From Tables 3 and 4, it is apparent that in the case of "example embodiment of the present invention" in which the chemical composition is within the range defined in the present invention, and moreover all of the amount of Al precipitating as AlN in each region and the density in terms of the number of AlN having a diameter of 100 nm or larger at the time when the region from the surface to one-fifth of the radius and the region from the center to one-fifth of the radius in the transverse cross section are observed, and the structure and the standard deviation of ferrite fractions at the time when randomly selected 15 viewing fields of a transverse cross section are observed and measured with the area per one viewing field being 62,500 μm² satisfy the conditions defined in the present invention (specifically, in the case where the steel is produced by production condition sign (2) and production condition sign (9)), even if the steel is heated and hot forged at various temperatures in the range of 900 to 1200° C., coarse grains are not formed until the carburization heating simulating temperature reaches 980° C., and the effect of preventing austenite grains from being coarsened can be achieved. However, in the case of "comparative example" in which all of the conditions defined in the present invention are not satisfied at the same time, the property of preventing austenite grains from being coarsened, which is the target of the present invention, is not achieved.

Example 2

Steels a to i each having a chemical composition given in Table 5 were put into a 70-ton converter to regulate the components. Thereafter, the steels were subjected to continuous casting to form a cast piece (bloom) of 400 mm×300 mm square, and were cooled to 600° C. At a stage during solidification in continuous casting, rolling reduction was applied.

All of steels a, b, and f to i given in Table 5 are steels whose chemical compositions are within the range defined in the present invention. On the other hand, steels c to e are steels of comparative example, whose chemical composition deviates from the condition defined in the present invention.

The cast piece thus produced was heated to a temperature of 600 to 1280° C., thereafter being bloomed to form a slab of 180 mm×180 mm square, and was cooled to room temperature. Further, the 180 mm×180 mm square slab was heated, and thereafter was hot rolled to form a steel bar having a diameter of 40 mm.

TABLE 5

| Steel | Chemical composition (mass %) Balance: Fe and impurities: C | Si | Mn | P | S | Cr | Ni | Mo | Al | Nb | Ti | V | N | O |
|---|---|---|---|---|---|---|---|---|---|---|---|---|---|---|
| a | 0.22 | 0.41 | 0.86 | 0.011 | 0.017 | 1.18 | — | — | 0.029 | — | 0.002 | — | 0.0118 | 0.0009 |
| b | 0.23 | 0.42 | 0.85 | 0.016 | 0.015 | 1.21 | — | — | 0.032 | — | 0.001 | — | 0.0213 | 0.0012 |
| c | 0.21 | 0.38 | 0.84 | 0.013 | 0.016 | 1.17 | — | — | 0.032 | — | 0.001 | — | *0.0092 | 0.0011 |
| d | 0.21 | 0.22 | 0.85 | 0.013 | 0.017 | 1.16 | — | — | *0.014 | — | 0.002 | — | 0.0153 | 0.0014 |
| e | 0.20 | 0.41 | 0.85 | 0.014 | 0.016 | 1.15 | — | — | *0.058 | — | 0.001 | — | 0.0168 | 0.0008 |

TABLE 5-continued

| Steel | Chemical composition (mass %) Balance: Fe and impurities | | | | | | | | | | | | | |
|---|---|---|---|---|---|---|---|---|---|---|---|---|---|---|
| | C | Si | Mn | P | S | Cr | Ni | Mo | Al | Nb | Ti | V | N | O |
| f | 0.21 | 0.22 | 0.78 | 0.011 | 0.021 | 1.07 | 0.53 | — | 0.031 | — | 0.001 | — | 0.0171 | 0.0009 |
| g | 0.21 | 0.08 | 0.72 | 0.015 | 0.015 | 1.03 | — | 0.38 | 0.030 | — | 0.002 | — | 0.0168 | 0.0010 |
| h | 0.21 | 0.42 | 0.51 | 0.011 | 0.015 | 1.51 | — | — | 0.024 | 0.035 | 0.001 | — | 0.0156 | 0.0009 |
| i | 0.22 | 0.51 | 0.49 | 0.011 | 0.018 | 1.49 | — | 0.21 | 0.031 | — | 0.001 | 0.08 | 0.0171 | 0.0008 |

*mark indicates that the value deviates from the condition defined in the present invention.

For each of the 40 mm-diameter steel bars obtained as described above, the region from the surface to one-fifth of the radius and the region from the center to one-fifth of the radius in the transverse cross section were observed by the same method as that in Example 1, and the amount of Al precipitating as AlN and the density in terms of the number of AlN having a diameter of 100 nm or larger were examined, and also the structure and the standard deviation of ferrite fractions at the time when randomly selected 15 viewing fields of a transverse cross section were observed and measured with the area per one viewing field being 62,500 $\mu m^2$ were examined. Further, a test simulating the heating in hot forging and carburizing was conducted to examine the presence of occurrence of coarse grains.

That is, by turning the 40 mm-diameter steel bar, a test specimen having a diameter of 39 mm and a length of 10 mm and a test specimen having a diameter of 8 mm and a length of 20 mm were sampled from the concentric positions. After the transverse cross section of each of the test specimens had been masked with a resin so as not to be electrolytically polished, extraction (electrolysis) was carried out at a current density of 250 to 350 $A/m^2$ by using a 10% AA-based electrolyte, which is the general condition, and the extracted solution was filtrated with a filter having a mesh size of 0.2 μm. Thereafter, the filtrated substance was chemically analyzed by the general method to determine the amount of Al precipitating as AlN.

In the transverse section of the steel bar having a diameter of 40 mm, from each of the region from the surface to one-fifth of the radius and the region from the center to one-fifth of the radius, an extraction replica specimen was prepared by the general method, and ten viewing fields were observed by using a transmission electron microscope with the magnification being ×20,000 and the area per one viewing field being 10 $\mu m^2$, whereby the density in terms of the number of AlN having a diameter of 100 nm or larger per 100 $\mu m^2$ of area was determined.

A test specimen was cut out of a cross section that was perpendicular to the longitudinal direction of 40 mm-diameter steel bar and included the center, and was mirror polished and corroded with nital, and randomly selected 15 viewing fields of the test specimen were observed with the magnification being ×400 and the size of viewing field being 250 μm×250 μm to examine the structure. Further, the ferrite fractions (area fractions) were determined by image analysis of the viewing fields by using the ordinary method, and from the analysis results, the standard deviation of ferrite fractions was calculated.

A test specimen having a length of 60 mm was cut out of the 40 mm-diameter steel bar, and was heated at temperatures of 1200° C., 1100° C., 1000° C., and 900° C. for 30 minutes to simulate hot forging. Thereafter, after 10 seconds from when the test specimen was taken out of the furnace, the test specimen was compressed by 60% in the height direction of the columnar shape, and subsequently was allowed to cool to room temperature. The test specimen thus obtained was further heated at 930° C. for one hour, and then was allowed to cool to room temperature.

Next, the test specimen obtained as described above was cut into four equal pieces in the longitudinal cross section direction, being held at temperatures of 950° C., 980° C., 1010° C., and 1040° C. for three hours to simulate heating for carburization, and thereafter was cooled to room temperature by water cooling. The cut surface of the test specimen thus obtained was removed by a thickness of 1 mm, and the cut surface was mirror polished and was corroded with a picric acid saturated aqueous solution to which a surface active agent was added. Then, randomly selected ten viewing fields were observed by using an optical microscope at a magnification of ×100 to examine the state in which the coarsening phenomenon of austenite grains occurred. The size of each viewing field in this examination was 1.0 mm×1.0 mm, and in the case where it was found by this examination that two or more austenite grains having a grain number of 5 or less were present, it was judged that austenite grains were coarsened. Similarly to the case of Example 1, the target of the effect of preventing austenite grains from being coarsened was made that austenite grains are not coarsened when the steel is heated at a temperature of 980° C. or lower for three hours.

Tables 6 and 7 summarize the results of the aforementioned examinations together with the production conditions of steel bar and the temperature at which the steel was heated to simulate hot forging. The production condition signs in Tables 6 and 7 correspond to the condition signs described in Table 2.

TABLE 6

| Steel | Production condition sign | Region from surface to 1/5 of radius in transverse cross section | | Region from center to 1/5 of radius in transverse cross section | | Standard deviation of ferrite fractions | Structure | Heating temperature in forging (° C.) | Formation temperature of coarsened austenite grains (° C.) | Classification |
|---|---|---|---|---|---|---|---|---|---|---|
| | | Al as AlN(%) | AlN having a diameter of 100 nm or larger (number/100 $\mu m^2$) | Al as AlN(%) | AlN having a diameter of 100 nm or larger (number/100 $\mu m^2$) | | | | | |
| a | <2> | 0.001 | 0 | 0.001 | 0 | 0.04 | F + P + B | 1200<br>1100 | 1040<br>1010 | Invention |

TABLE 6-continued

| Steel | Production condition sign | Region from surface to 1/5 of radius in transverse cross section: Al as AlN(%) | Region from surface to 1/5 of radius in transverse cross section: AlN having a diameter of 100 nm or larger (number/100 μm²) | Region from center to 1/5 of radius in transverse cross section: Al as AlN(%) | Region from center to 1/5 of radius in transverse cross section: AlN having a diameter of 100 nm or larger (number/100 μm²) | Standard deviation of ferrite fractions | Structure | Heating temperature in forging (° C.) | Formation temperature of coarsened austenite grains (° C.) | Classification |
|---|---|---|---|---|---|---|---|---|---|---|
| | | | | | | | | 1000 | 1010 | |
| | | | | | | | | 900 | 1040 | |
| | <8> | *0.007 | *7 | *0.010 | *12 | 0.04 | F + P | 1200 | 1040 | Comparative |
| | | | | | | | | 1100 | #950 | |
| | | | | | | | | 1000 | #950 | |
| | | | | | | | | 900 | #950 | |
| b | <2> | 0.003 | 1 | 0.004 | 2 | 0.03 | F + P + B | 1200 | >1040 | Invention |
| | | | | | | | | 1100 | 1010 | |
| | | | | | | | | 1000 | 1040 | |
| | | | | | | | | 900 | >1040 | |
| | <4> | *0.016 | *12 | *0.018 | *11 | 0.02 | F + P | 1200 | 1040 | Comparative |
| | | | | | | | | 1100 | #950 | |
| | | | | | | | | 1000 | #950 | |
| | | | | | | | | 900 | 1010 | |
| *c | <2> | 0.001 | 0 | 0.001 | 0 | 0.04 | F + P + B | 1200 | 1010 | Comparative |
| | | | | | | | | 1100 | #950 | |
| | | | | | | | | 1000 | #950 | |
| | | | | | | | | 900 | #980 | |
| | <5> | 0.002 | 1 | 0.004 | 2 | 0.04 | F + P + B | 1200 | 1010 | Comparative |
| | | | | | | | | 1100 | #950 | |
| | | | | | | | | 1000 | #950 | |
| | | | | | | | | 900 | #950 | |
| *d | <2> | 0.001 | 0 | 0.001 | 0 | 0.04 | F + P + B | 1200 | #980 | Comparative |
| | | | | | | | | 1100 | #950 | |
| | | | | | | | | 1000 | #950 | |
| | | | | | | | | 900 | #980 | |
| | <3> | 0.002 | 4 | 0.003 | *5 | 0.04 | F + P + B | 1200 | 1010 | Comparative |
| | | | | | | | | 1100 | #950 | |
| | | | | | | | | 1000 | #950 | |
| | | | | | | | | 900 | #950 | |
| *e | <1> | *0.014 | *15 | *0.023 | *37 | 0.03 | F + P + B | 1200 | #980 | Comparative |
| | | | | | | | | 1100 | #950 | |
| | | | | | | | | 1000 | #950 | |
| | | | | | | | | 900 | 1010 | |

"Invention" in classification column indicates example embodiment of the present invention, and "Comparative" indicates comparative example.
Production condition signs correspond to condition signs described in Table 2.
"Al as AlN" means the amount of Al precipitating as AlN.
"F" in Structure column indicates ferrite, "P" indicates pearlite, and "B" indicates bainite.
*mark indicates that the value deviates from the condition defined in the present invention.
#mark indicates that the target is not reached.

TABLE 7

| Steel | Production condition sign | Region from surface to 1/5 of radius in transverse cross section: Al as AlN(%) | Region from surface to 1/5 of radius in transverse cross section: AlN having a diameter of 100 nm or larger (number/100 μm²) | Region from center to 1/5 of radius in transverse cross section: Al as AlN(%) | Region from center to 1/5 of radius in transverse cross section: AlN having a diameter of 100 nm or larger (number/100 μm²) | Standard deviation of ferrite fractions | Structure | Heating temperature in forging (° C.) | Formation temperature of coarsened austenite grains (° C.) | Classification |
|---|---|---|---|---|---|---|---|---|---|---|
| *e | <2> | *0.008 | *7 | *0.015 | *18 | 0.02 | F + P + B | 1200 | 1010 | Comparative |
| | | | | | | | | 1100 | #950 | |
| | | | | | | | | 1000 | #950 | |
| | | | | | | | | 900 | #950 | |
| f | <2> | 0.002 | 0 | 0.002 | 1 | 0.06 | F + P + B | 1200 | >1040 | Invention |
| | | | | | | | | 1100 | 1010 | |
| | | | | | | | | 1000 | 1040 | |
| | | | | | | | | 900 | >1040 | |
| | <6> | *0.008 | 0 | *0.010 | 1 | 0.02 | F + P | 1200 | >1040 | Comparative |
| | | | | | | | | 1100 | #950 | |
| | | | | | | | | 1000 | #980 | |
| | | | | | | | | 900 | 1010 | |
| g | <7> | 0.003 | 0 | 0.004 | 2 | *0.13 | F + B | 1200 | >1040 | Comparative |
| | | | | | | | | 1100 | #980 | |
| | | | | | | | | 1000 | #980 | |
| | | | | | | | | 900 | #950 | |

TABLE 7-continued

| Steel | Production condition sign | Region from surface to 1/5 of radius in transverse cross section: Al as AlN(%) | Region from surface to 1/5 of radius in transverse cross section: AlN having a diameter of 100 nm or larger (number/100 μm²) | Region from center to 1/5 of radius in transverse cross section: Al as AlN(%) | Region from center to 1/5 of radius in transverse cross section: AlN having a diameter of 100 nm or larger (number/100 μm²) | Standard deviation of ferrite fractions | Structure | Heating temperature in forging (° C.) | Formation temperature of coarsened austenite grains (° C.) | Classification |
|---|---|---|---|---|---|---|---|---|---|---|
| | <2> | 0.002 | 0 | 0.002 | 1 | 0.08 | F + B | 1200 | >1040 | Invention |
| | | | | | | | | 1100 | 1010 | |
| | | | | | | | | 1000 | 1040 | |
| | | | | | | | | 900 | >1040 | |
| h | <2> | 0.001 | 0 | 0.001 | 1 | 0.06 | F + P + B | 1200 | >1040 | Invention |
| | | | | | | | | 1100 | 1040 | |
| | | | | | | | | 1000 | >1040 | |
| | | | | | | | | 900 | >1040 | |
| | <1> | 0.003 | 3 | 0.005 | *9 | 0.05 | F + P + B | 1200 | 1040 | Comparative |
| | | | | | | | | 1100 | #980 | |
| | | | | | | | | 1000 | 1010 | |
| | | | | | | | | 900 | 1010 | |
| i | <2> | 0.002 | 1 | 0.002 | 2 | 0.07 | F + B | 1200 | >1040 | Invention |
| | | | | | | | | 1100 | 1040 | |
| | | | | | | | | 1000 | 1040 | |
| | | | | | | | | 900 | >1040 | |
| | <5> | 0.003 | 1 | *0.007 | *7 | 0.04 | F + P + B | 1200 | >1040 | Comparative |
| | | | | | | | | 1100 | #980 | |
| | | | | | | | | 1000 | 1010 | |
| | | | | | | | | 900 | 1040 | |

"Invention" in classification column indicates example embodiment of the present invention, and "Comparative" indicates comparative example.
Production condition signs correspond to condition signs described in Table 2.
"Al as AlN" means the amount of Al precipitating as AlN.
"F" in Structure column indicates ferrite, "P" indicates pearlite, and "B" indicates bainite.
*mark indicates that the value deviates from the condition defined in the present invention.
#mark indicates that the target is not reached.

From Tables 6 and 7, it is apparent that in the case of "example embodiment of the present invention" in which the chemical composition is within the range defined in the present invention, and moreover all of the amount of Al precipitating as AlN in each region and the density in terms of the number of AlN having a diameter of 100 nm or larger at the time when the region from the surface to one-fifth of the radius and the region from the center to one-fifth of the radius in the transverse cross section are observed, and the structure and the standard deviation of ferrite fractions at the time when randomly selected 15 viewing fields of a transverse cross section are observed and measured with the area per one viewing field being 62,500 μm² satisfy the conditions defined in the present invention, even if the steel is heated and hot forged at various temperatures in the range of 900 to 1200° C., coarse grains are not formed until the carburization heating simulating temperature reaches 980° C., and the effect of preventing austenite grains from being coarsened can be achieved.

In contrast, in the case of "comparative example" in which all of the conditions defined in the present invention are not satisfied at the same time, the property of preventing austenite grains from being coarsened, which is the target of the present invention, is not achieved.

Although only some exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention.

INDUSTRIAL APPLICABILITY

The hot-rolled steel bar or wire rod in accordance with the present invention is suitable as a starting material for parts, such as gears, pulleys, and shafts, that are roughly formed by hot forging because austenite grains can be stably prevented from being coarsened when the steel is heated in the process of carburizing or carbo-nitriding, especially when the steel is heated at a temperature of 980° C. or lower for three hours or shorter even if being hot forged in various temperature ranges, especially being hot forged after being heated to 900 to 1200° C.

The invention claimed is:

1. A hot-rolled steel bar or wire rod having a chemical composition consisting of, by mass percent, C: 0.1 to 0.3%, Si: 0.05 to 1.5%, Mn: 0.4 to 2.0%, S: 0.003 to 0.05%, Cr: 0.5 to 3.0%, Al: 0.02 to 0.05%, and N: 0.010 to 0.025%, the balance being Fe and impurities, and the contents of P, Ti and O in the impurities being P: 0.025% or less, Ti: 0.003% or less, and O: 0.002% or less, wherein the structure of the hot-rolled steel bar or wire rod is composed of a ferrite-pearlite structure, ferrite-pearlite-bainite structure, or ferrite-bainite structure;

the standard deviation of ferrite fractions at the time when randomly selected 15 viewing fields of a transverse cross section are observed and measured with the area per one viewing field being 62,500 μm² is 0.10 or less; and when a region from the surface to one-fifth of the radius and a region from the center to one-fifth of the radius in the transverse cross section are observed, in each of the regions, the amount of Al precipitating as AlN is 0.005% or less, and the density in terms of the number of AlN having a diameter of 100 nm or larger is 5/100 μm² or less.

2. The hot-rolled steel bar or wire rod according to claim 1, wherein the chemical composition further contains, by mass percent, at least one element selected from Ni: 1.5% or less and Mo: 0.8% or less in lieu of part of Fe.

3. The hot-rolled steel bar or wire rod according to claim 1, wherein the chemical composition further contains, by mass percent, at least one element selected from Nb: 0.08% or less and V: 0.2% or less in lieu of part of Fe.

4. The hot-rolled steel bar or wire rod according to claim 2, wherein the chemical composition further contains, by mass percent, at least one element selected from Nb: 0.08% or less and V: 0.2% or less in lieu of part of Fe.

* * * * *